United States Patent [19]

Schaub

[11] Patent Number: 4,659,333

[45] Date of Patent: Apr. 21, 1987

[54] PROCESS FOR FIXING DYES AND PRINTS WITH HOT STEAM CONTAINING AIR

[75] Inventor: Andres Schaub, Biel-Benken, Switzerland

[73] Assignee: CIBA-GEIGY Corporation, Ardsley, N.Y.

[21] Appl. No.: 770,811

[22] Filed: Aug. 29, 1985

[30] Foreign Application Priority Data

Sep. 28, 1984 [CH] Switzerland ..... 4647/84

[51] Int. Cl.[4] ..... D06P 5/20

[52] U.S. Cl. ..... 8/476; 8/475; 8/532; 8/543; 8/662; 8/681; 8/685; 8/918; 68/5 R

[58] Field of Search ..... 8/476

[56] References Cited

U.S. PATENT DOCUMENTS 4,465,490 8/1984 von der Eltz ..... 8/400

FOREIGN PATENT DOCUMENTS 2552562 7/1976 Fed. Rep. of Germany .
2829287 1/1979 Fed. Rep. of Germany .
978150 12/1964 United Kingdom .
1134703 11/1968 United Kingdom .

OTHER PUBLICATIONS

L. W. C. Miles, Textile Printing, 1981, pp. 120 to 123 and 264 to 283.

The Journal of the Society of Dyers and Colourists, vol. 94, May 1978 (pp. 177–189).

*Primary Examiner*—A. Lionel Clingman

*Attorney, Agent, or Firm*—Joseph G. Kolodny

[57] ABSTRACT

The invention relates to a process for fixing azo, metal complex azo and formazan dyes on textile fabrics with hot steam to give stable shades, which process comprises fixing textile fabrics dyed or printed with said dyes in hot steam that contains at least 0.5% by volume of air.

15 Claims, No Drawings

PROCESS FOR FIXING DYES AND PRINTS WITH HOT STEAM CONTAINING AIR

The present invention relates to a novel process for fixing azo, metal complex azo and formazan dyes on textile fabrics with hot steam to give stable shades.

One of the best known and commonest methods of dye fixation on dyed or printed goods is steam fixation. Steaming dyed or printed goods with water vapour is one of the most important steps in textile dyeing and, in particular, in textile printing. On it depend the fixation and degree of fixation and hence the tinctorial strength and fastness properties of the dyeings or prints. For this reason the steaming procedure requires particular attention and careful monitoring.

If steam is employed for dye fixation, in particular of textile prints, it must fulfill a number of functions, for example:

1. supplier of water by condensation in all single step processes (dry goods are introduced into the steamer);
2. energy supply for accelerating the diffusion of the dye;
3. energy supply for initiating the chemical reactions for the fixation process (e.g. decomposition of sodium formaldehyde sulfoxylate when using vat dyes);
4. energy removal for preventing overheating in exothermic steps such as chemical reactions, adsorption of $H_2O$ etc.;
5. inert gas function to counteract the influence of atmospheric oxygen on redox processes in dyes and thickeners;
6. entrainer for volatile reaction products from fixation processes.

Whereas all functions 1–6 are required for the steam fixation of vat dyes by the single step process, not all are of equal importance for the fixation of dyeings and prints obtained with dyes of other classes (substantive, leuco-vat ester, reactive, acid, metal complex, disperse and cationic dyes).

One requirement of the quality of the steam that is repeatedly made in numerous publications, for example in "Textile Printing" by L. W. C. Miles, Dyers Company Publications Trust, 1981, is that the steam must be air-free. The air content of the steam should be less than 0.3% by volume. This requirement is usually exceeded by present-day steamers and the air content is often less than 0.1% by volume.

Another recurring phenomenon of steam fixation is the deviation in shade when fixing in particular light shades obtained with dyes which are sensitive to reduction. All azo, metal complex azo and formazan dyes are considered as partially or completely sensitive to reduction.

The deviations in shade that occur on fixation are generally attributable to the reducing action of steam caused by boiler water additives, for example hydrazines. However, printing pastes too, which contain for example a sodium alginate thickener and fixation alkali, evidently have a reducing action.

It is the object of the present invention to provide a steam fixation process which affords dyeings and, in particular, prints that have stable shades even when using dyes that are sensitive to reduction. This object is achieved by means of the process of this invention.

Accordingly, the present invention relates to a process for fixing azo, metal complex azo and formazan dyes on textiles with hot steam to give stable shades, which process comprises drying textiles dyed or printed with said dyes and then carrying out fixation in hot steam that contains at least 0.5% by volume of air.

Surprisingly, the dyeings and prints obtained by the process of this invention have stable shades. Contrary therefore to the general requirement that the steamer should be substantially air-free, an air content of at least 0.5% by volume is necessary to prevent deviations in shade of the dyeings and prints obtained by steam fixation when using specific classes of dye.

In the process of this invention, an intermediate drying of the dyed or printed textile fabrics before the steam fixation is mandatory.

A preferred embodiment of the process of this invention comprises using textile fabrics that are dyed or printed with dyes sensitive to reduction, in particular with textile fabrics that are dyed or printed with water-insoluble and/or water-soluble dyes and, most preferably, textile fabrics that are dyed or printed with water-soluble reactive dyes.

A further preferred embodiment of the process of this invention comprises carrying out fixation in steam that contains 0.5 to 5% by volume of air, preferably 1.5 to 5% by volume of air and, most preferably, 1.5 to 3.5% by volume of air. In the process of this invention an air content of at least 1% by volume has proved especially advantageous. An air content of 10% by volume has proved useful as upper limit.

Yet another preferred embodiment of the invention comprises carrying out fixation under normal pressure.

In the process of this invention, a temperature range from 100° to 220° C., preferably from 100° to 105° C. or 150° to 190° C., under a pressure of 1 bar, has proved particularly advantageous.

A particularly preferred embodiment of the process of this invention comprises using printed textile fabrics, preferably those that are printed with printing pastes containing a reduction-promoting thickener.

The printed textile fabrics preferably employed in the process of this invention are those made of fibre blends, in particular polyester/cellulose blends and, most particularly, of cellulose fibres, which fabrics are printed with mixtures of dyes containing at least one water-soluble reactive dye and at least one disperse dye.

As printed polyester/cellulose blend it is particularly preferred to use one that is printed with a printing paste containing at least one water-soluble reactive dye, at least one disperse dye, alginate and fixation alkali, and, most particularly, one that is printed with a printing paste containing at least one fibre-reactive sulfo group containing azo or metal complex azo dye, at least one azo disperse dye and a fixation alkali, and which is fixed in steam containing 1.5 to 3.5% by volume of air under normal pressure and in the temperature range from 150° to 220° C.

Suitable textile fabrics are those made of natural and synthetic fibres and mixtures thereof. Representative examples are: cotton, linen (bleached), viscose, polynosics, copper synthetic fibres, wool, silk, synthetic polyamide, polyester and polyurethane fibres, wool/polyamide, wool/polyester, wool/cellulose, wool/acrylic and polyester/cellulose blends.

As textile fabrics it is preferred to use synthetic polyamide, polyester, cellulose fibres, and polyester/cellulose blends.

The textile fabrics are dyed or printed by methods which are known per se, dried, and subsequently fixed by the process of this invention.

Fixation is carried out in one of the continuous or batch steamers which are known per se and commercially available and which must be provided with means for the controlled admission of air. The air inlet can for example be controlled by a valve.

The type of steam in the process of this invention corresponds to that conventionally employed in industrial steamers, for example saturated steam and superheated steam.

Steaming time and steaming temperature depend on the dyes and the textile fabrics employed.

In the process of this invention, textile fabrics are employed that are printed with azo, metal complex azo and formazan dyes. These dyes may be water-soluble or water-insoluble.

Suitable disperse dyes are e.g. those known from the Colour Index as disperse dyes.

Suitable water-soluble dyes which contain e.g. one or more sulfonic acid groups as water-solubilising group are non-reactive or fibre-reactive dyes, for example those listed in the Colour Index as acid, direct and reactive dyes. In particular, the water-soluble dyes are derived from the following dyes:

1. Monoazo compounds of the formula

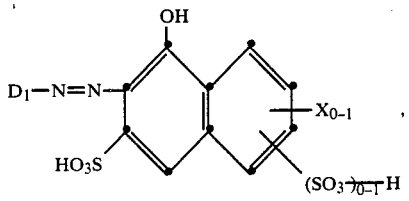

(1)

wherein $D_1$ is a radidal of the benzene or naphthalene series, for example the phenyl, naphthyl, stilbene, diphenyl, benzthiazolylphenyl or diphenylamine radical which may be substituted by sulfo groups, halogen such as chlorine, ethylamino groups such as ethylamino or benzoylamino, amino groups such as $-NH_2$ and methylamino, alkoxy such as methoxy, hydroxy and carboxy, as well as fibre-reactive radicals X.

2. Disazo compounds of the formula (1), wherein $D_1$ is a radical of the azobenzene, azonaphthalene or phenylazonaphthalene series, and $D_1$ and the naphthalene nucleus may be substituted, as indicated for class 1.

3. Disazo compounds of the formula

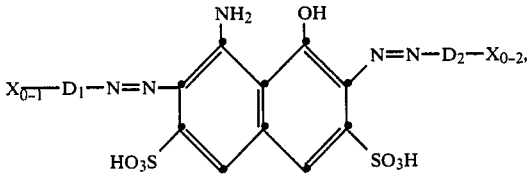

(2)

wherein X, $D_1$ and $D_2$ each independently are as defined for $D_1$ in formula (1).

4. Monoazo compounds of the formula

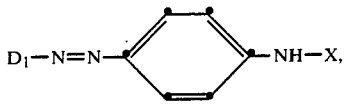

(3)

wherein $D_1$ is a radical as defined for formula (1), in particular a disulfonaphthyl or stilbene radical, and X is as defined for formula (1) and the benzene nucleus may contain further substituents, for example halogen atoms or alkyl, alkoxy, carboxylic acid, ureido and acylamino groups.

5. Mono- or disazo compounds of the formula $$X_{0-1}D_1-N=N-K_1 \quad (4),$$

wherein $D_1$ is a radical of the azobenzene, azonaphthalene or phenylazonaphthalene series or is preferably a radical of the benzene or naphthalene series which may be substituted by the substituents as indicated for $D_1$ in formula (1), and $K_1$ is the radical of a naphtholsulfonic acid or the radical of a ketomethylene compound, for example an acetoacetarylide, preferably an acetoacetanilide, or a 5-pyrazolone, preferably a 1-phenyl-3-methyl-5-pyrazol-one, in which the OH group is in the ortho-postion to the azo group, and X is as defined for formula (1). Preferably $D_1$ is a radical of the benzene series which contains a sulfonic acid group.

6. Mono- or disazo compounds of the formula $$D_1-N=N-K_2-X_{0-1} \quad (5),$$

wherein $D_1$ is a radical as defined for $D_1$ in classes 1 and 2 above and $K_2$ is the radical of an enolisable ketomethylene compound such as an acetoacetarylide, preferably an acetoacetanilide or a 5-pyrazol-one, preferably a 1-phenyl-3-methyl-5-pyrazolone, in which the OH group is in the ortho-position to the azo group and X is as defined for class 1.

7. Metal complex compounds such as copper, chromium and cobalt complexes of the dyes of formulae (1) to (5), wherein $D_1$, $K_1$ and $K_2$ have the given meanings and further contain a metallisable group, for example a hydroxyl, methoxy or carboxylic acid group, in the ortho-position to the azo group.

8. Metal complexes of formazan dyes of the formula

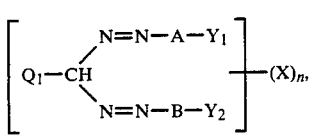

(6)

wherein $Q_1$ is an organic radical or a nitro or cyano group, A and B are radicals of diazo components of the benzene, naphthalene or heterocyclic series and each of $Y_1$ and $Y_2$ is a substituent which is in the ortho-position to the azo group and which is able to form a complex with a heavy metal, X is as defined for formula (1), and n is 0, 1 or 2.

The radical $Q_1$ is in particular a radical of the benzene series, for example a phenyl or sulfophenyl radical or an alkyl radical such as methyl, a low molecular alkanoyl group, for example acetyl, a carbalkoxy group of 1 to 4 carbon atoms, a benzoyl group or a heterocyclic radical, and A and B are preferably phenyl radicals which are substituted by sulfo, sulfonamido or alkylsulfonyl groups. $Y_1$ and $Y_2$ are preferably OH and COOH groups. Suitable heavy metals are copper, chromium, cobalt and nickel.

In the process of this invention it is preferred to fix cellulose fabrics printed with fibre-reactive azo dyes. It is also preferred to fix polyester/cellulose blends which are printed with mixtures of dyes containing at least one fibre-reactive azo dye and at least one disperse azo dye.

By fibre-reactive radicals X are meant those radicals that are able to react with the hydroxyl groups of cellulose, the amino, carboxyl, hydroxyl and thiol groups of wool and silk, or with the amino and, where available, carboxyl groups of synthetic polyamides to form covalent bonds.

Preferably X is a fibre-reactive radical of the aliphatic, aromatic or heterocyclic series, which radical is attached to the radical D direct or through a bridge, wherein D is an azo, metal complex azo or formazan dye.

The fibre-reactive radical X is preferably attached to the radical D direct or through an unsubstituted or monoalkylated amino group such as —NH—, —N($CH_3$)—, —N($C_2H_5$)— or —N($C_3H_7$)— or though a bridge that carries an amino group.

Suitable fibre-reactive radicals X in formulae (1) to (6) are for example: vinylsulfonyl, β-chloroethylsulfonyl, β-sulfatoethylsulfonyl, β-acetoxyethylsulfonyl, phosphonooxyethylsulfonyl, β-thiosulfatoethylsulfonyl, N-methyl-N-(β-sulfatoethylsulfonyl)amino, acryloyl, monochloroacryloyl, dichloroacryloyl or trichloroacryloyl such as —CO—CCl=$CH_2$, —CO—CH=CH—Cl, —CO—CCl=CH—$CH_3$; monobromoacryloyl, dibromoacryloyl or tribromoacryloyl such as —CO—CBr=$CH_2$, —CO—CH=CH—Br, —CO—CBr=CH—$CH_3$; as well as —CO—CCl=CH—COOH, —CO—CH=CCl—COOH, —CO—CBr=CH—COOH, —CO—CH=CBr—COOH; —CO—CCl=CCl—COOH, —CO—CBr=CBr—COOH; precursors of the acryloyl radical and of derivatives of the acryloyl radical such as β-chloropropionyl, β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl; as well as 2-fluoro-2-chloro-3,3-difluorocyclobutane-1-carbonyl, 2,2,3,3-tetrafluorocyclobutane-1-carbonyl or -1-sulfonyl, β-(2,2,3,3-tetrafluorocyclobut-1-yl)acryloyl, α- or β-alkenylsulfonylacryloyl or -arylsulfonylacryloyl groups, such as α- or β-methylsulfonylacryloyl, propiolyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl; as well as 4-fluoro-3-nitrobenzoyl, 4-fluoro-3-nitrophenylsulfonyl, 4-fluoro-3-methylsulfonylbenzoyl, 4-fluoro-3-cyanobenzoyl, and 2-fluoro-5-methylsulfonylbenzoyl.

Further examples of fibre-reactive radicals X belong to the heterocyclic series, such as 2,4-dichlorotriazin-6-yl, monohalopyrimidinyl, dihalopyrimidinyl or trihalopyrimidinyl radicals, such as 2,4-dichloropyrimidin-6-yl, 2,4,5-trichloropyrimidin-6-yl, 2,4-dichloro-5-nitro or 5-methyl or 5-carboxymethyl- or -5-carboxyor -5-cyano or -5-vinyl- or -5-sulfo- or -5-monochloromethyl, -dichloromethyl- or trichloromethyl- or 5-methylsulfonyl-6-pyrimidinyl, 2,5-dichloro-4-methylsulfonyl-6-pyrimidinyl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6-chloromethyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl or 5-methylsulfonyl-4-pyrimidinyl, 2-fluoro-5-carbamoyl-4-pyrimidinyl, 2-fluoro-5-carbomethoxy-4-pyrimidinyl, 2-fluoro-5-bromo-6-trifluoromethyl-4-pyrimidinyl, 2-fluoro-6-carbamoyl-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl; 2,4-bismethylsulfonylpyrimidin-4-yl, 2,5-bismethylsulfonyl-5-chloropyrimidin-4-yl, 2-methylsulfonylpyrimidin-4-yl, 2-phenylsulfonylpyrimidin-4-yl, 2-methylsulfonyl-5-chloro-6-methylpyrimidin-4-yl, 2-methylsulfonyl-5-bromo-6-methylpyrimidin-4-yl, 2-methylsulfonyl-5-chloro-6-ethylpyrimidin-4-yl, 2-methylsulfonyl-5-chloromethylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin-4-yl, 2,6-bismethylsulfonyl-5-chloropyrimidin-4-yl, 2-methylsulfonyl-6-carboxypyrimidin-4-yl, 2-methylsulfonyl-5-sulfopyrimidin-4-yl, 2-methylsulfonyl-6-carbomethoxypyrimidin-4-yl, 2-methylsulfonyl-5-carboxypyrimidin-4-yl, 2-methylsulfonyl-5-cyano-6-methoxypyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloropyrimidin-4-yl, 2-carboxymethylsulfonyl-5-chloro-6-methylpyrimidin-4-yl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl or -5-sulfonyl, 2-methylsulfonyl-6-chloropyrimidine-4-and -5-carbonyl, 2,6-bis(methylsulfonyl)pyrimidine-4- or -5-carbonyl, 2-ethylsulfonyl-6-chloropyrimidine-5-carbonyl, 2,4-bis(methylsulfonyl)pyrimidine-5-sulfonyl, 2-methylsulfonyl-4-chloro-6-methyl-pyrimidine-5-sulfonyl or -5-carbonyl, 2-chloroquinoxaline-3-carbonyl, 2- or 3-monochloroquinoxaline-6-carbonyl, 2- or 3-monochloroquinoxaline-6-sulfonyl, 2,3-dichloroquinoxaline-5- or -6-carbonyl, 2,3-dichloroquinoxaline-5- or -6-sulfonyl, 1,4-dichlorophthalazine-6-sulfonyl- or -6-carbonyl, 2,4-dichloroquinazoline-7-or -6-sulfonyl or -carbonyl, 2,4,6-trichloroquinazoline-7- or -8-sulfonyl, 2- or 3- or 4-(4', 5'-dichloropyridazinone-6'-yl-1')-propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or -alkylsulfonylbenzothiazole-5- or -6-carbonyl- or -5- or -6-sulfonyl, such as 2-methylsulfonylbenzothiazole- or 2-ethylsulfonylbenzothiazole-5- or -6-sulfonyl or -carbonyl, 2-phenylsulfonylbenzothiazole-5- or -6-sulfonyl- or -carbonyl and the corresponding 2-sulfonylbenzothiazole-5- or -6-carbonyl or -sulfonyl derivatives which contain sulfo groups in the fused benzene ring, 2-chlorobenzoxazole-5- or -6-carbonyl or -sulfonyl, 2-chlorobenzimidazole-5- or -6-carbonyl- or -sulfonyl, 2-chloro-1-methylbenzimidazole-5- or -6-carbonyl- or -sulfonyl, 2-chloro-4-methylthiazole-(1,3)-5-carbonyl or -4- or -5-sulfonyl; ammonium-containing triazine rings, such as 2-trimethylammonium-4-phenyl amino- or 4-(o-, m- or p-sulfophenyl)amino-6-triazinyl, 2-(1,1-dimethylhydrazinium)-4-phenylaminotriazin-6-yl, 2-(1,1-dimethylhydrazinium)-4-(o-, m- or p-sulfophenyl)aminotriazin-6-yl, 2-(2-isopropylidene-1,1-dimethyl)hydrazinium-4-phenylaminotriazin-6-yl, 2-(2-isopropylidene-1,1-dimethyl)hydrazinium-4-(o-, m- or p-sulfophenyl)aminotriazin-6-yl, 2-N-aminopyrrolidinium- or 2-N-aminopiperidinium-4-phenylaminotriazin-6-yl or -4-(o-, m- or p-sulfophenyl)aminotriazin-6-yl, and also 4-phenylaminotriazin-6-yl and 4-(sulfophenylamino)triazin-6-yl radicals which contain 1,4-bisazabicyclo[2.2.2]octane or 1,2-bisazabicyclo[0.3.-3]octane attached through a quaternary nitrogen bound in the 2-position, 2-pyridinium-4-phenylaminotriazin-6-yl or 2-pyridinium-4-(o-, m- or p-sulfophenyl)aminotriazin-6-yl as well as the corresponding 2-oniumtriazin-6-yl radicals which are substituted in the 4-position by alkylamino such as methylamino, ethylamino or β-hydroxyethylamino, alkoxy such as methoxy or ethoxy, or aryloxy such as phenoxy, or sulfophenoxy groups.

Particularly interesting fibre-reactive radicals are fluoro-1,3,5-triazine radicals of the formula

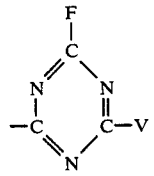

wherein the substituent V on the triazine ring may be in particular: —$NH_2$, alkylamino, N,N-dialkylamino, cycloalkylamino, N,N-dicycloalkylamino, aralkylamino and arylamino groups, mixed substituted amino groups such as N-alkyl-N-cyclohexylamino and N-alkyl-N-arylamino groups, amino groups which contain heterocyclic radicals which may carry further fused carbocyclic rings, amino groups in which the amino nitrogen atom is part of a N-heterocyclic ring which may contain further heteroatoms, and hydrazino and semicarbazido. The above-mentioned alkyl radicals can be straight-chain or branched and be of low molecular weight or higher molecular weight, with alkyl radicals of 1 to 6 carbon atoms being preferred; suitable cycloalkyl, aralkyl and aryl radicals are in particular cyclohexyl, benzyl, phenethyl, phenyl and naphthyl radicals: heterocyclic radicals are in particular furan, thiophene, pyrazole, pyridine, pyrimidine, quinoline, benzimidazole, benzothiazole and benzoxazole radicals; and amino groups in which the amino nitrogen atom is part of a N-heterocyclic ring are preferably radicals of 6-membered N-heterocyclic compounds which may contain nitrogen, oxygen or sulfur as further heteroatoms. The above-mentioned alkyl, cycloalkyl, aralkyl and aryl radicals, the heterocyclic radicals and the N-heterocyclic rings may be further substituted, for example by: halogen such as fluorine, chlorine and bromine; nitro, cyano, trifluoromethyl, sulfamoyl, carbamoyl, $C_{1-4}$alkyl, $C_{1-4}$alkoxy; acylamino groups such as acetylamino or benzoylamino; ureido, hydroxyl, carboxyl, sulfomethyl or sulfo. Examples of amino groups of this type are: -$NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfonaphth-1-ylamino, 3,6-disulfonaphth-1-ylamino, 3,6,8-trisulfonaphth-1-ylamino, 4,6,8-trisulfonaphth-1-ylamino, 1-sulfonaphth-2-ylamino, 1,5-disulfonaphth-2-ylamino, 6-sulfonaphth-2-ylamino, morpholino, piperidino, piperazino, hydrazino and semicarbazido.

The reactive dyes of the formula (1) can contain up to 6 reactive groups of identical or different types.

Suitable dyes which are highly sensitive to reduction are in particular those azo, metal complex azo or formazan dyes which decompose to an amount of at least 1% during the fixation procedure when dyed or printed on textile fabrics in conventional steamers containing less than 0.3% by volume of air.

A material advantage of the process of this invention resides in the feature that, in continuous as well as batchwise steam fixation, no deviations in shade occur and a constant tinctorial strength of the dyes employed is ensured. This advantage is of especial importance for light shades, i.e. for textile fabrics which are dyed or printed with less than 0.5% of dye, based on the weight of the fibre.

A further advantage of the process of this invention is that it is possible to use textile fabrics that are printed with printing pastes containing thickeners with reducing properties.

Accordingly, the present invention also relates to a composition for carrying out the process of the invention. The invention thus further relates to a steam chamber for the fixation of dyed or printed textile fabrics in hot steam, said steam chamber containing means for admitting air. A valve, for example, may be used as means for admitting air. Preferably the air is admitted and mixed with the steam by means of a valve which can be regulated externally.

The invention is illustrated in more detail by the following Examples, in which parts and percentages are by weight. The relationship between parts by weight and parts by volume is the same as that between the gram and the cubic centimeter.

EXAMPLE 1

A printing paste of the following composition is prepared:

5 g of the reactive dye of the formula

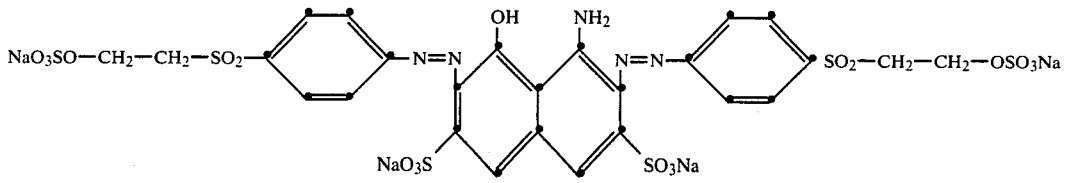

and 100 g of urea are dissolved in
355 g of water and then homogenised with
500 g of a 10% sodium alginate thickener. Then
30 g of calcined sodium carbonate and
10 g of sodium o-nitrobenzenesulfonate are strewed in and the mixture is stirred with an impeller until a solution is obtained.

Cotton fabric is printed with this paste in conventional manner (flat screen or rotary screen printing or roller printing) and then dried.

The printed fabric is fixed by steaming it for 8 minutes in steam without overpressure (~1 bar) at 100°-102° C. The steam contains 1.5-2% by volume of air. After conventional washing-off, the prints so obtained have a bluish grey shade.

If a comparison print is fixed in corresponding manner in steam that contains only 0.05% by volume of air, a pink shade is obtained instead of the desired bluish grey shade, i.e. the dye has been partly decomposed during fixation.

Prints with stable shades are also obtained by carrying out the procedure of this Example using the dyes and textile fabrics indicated in columns II and III of the following table and fixing the resultant prints under the conditions stated in column IV.

TABLE

| Example I | II | III | IV |
|---|---|---|---|
| 2 | 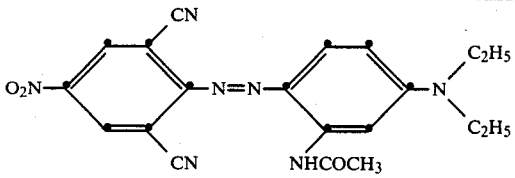 | polyester | 20 minutes at 2.5 bar in saturated steam |
| 3 | mixture of 1 part of the dye of the formula 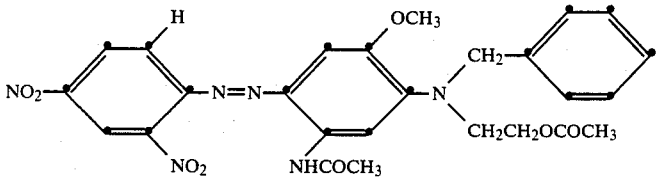 and 3 parts of the dye of the formula 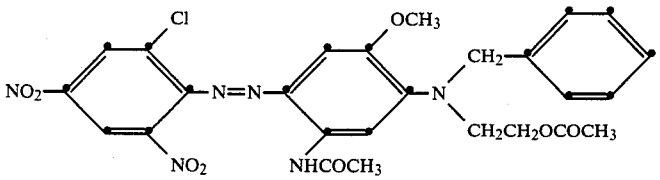 | polyester | 10 minutes at 1 bar in saturated steam and 10 minutes at 170° C. in superheated steam |
| 4 | 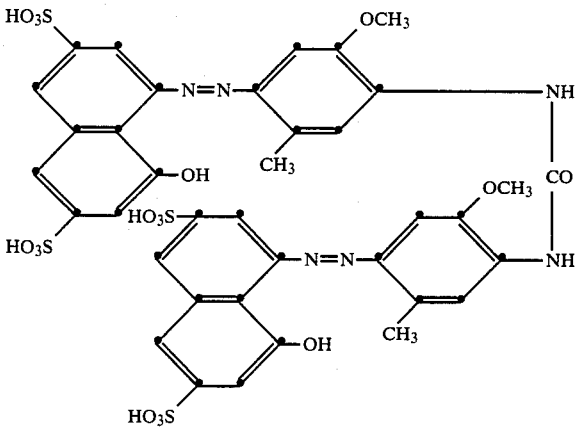 | cotton | 20 minutes at 1 bar in saturated steam |

TABLE-continued

| Example I | II | III | IV |
|---|---|---|---|
| 5 | 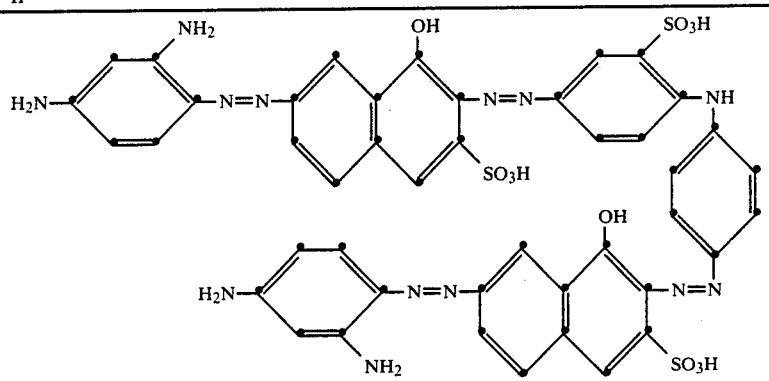 | cotton | 20 minutes at 1 bar in saturated steam |
| 6 | 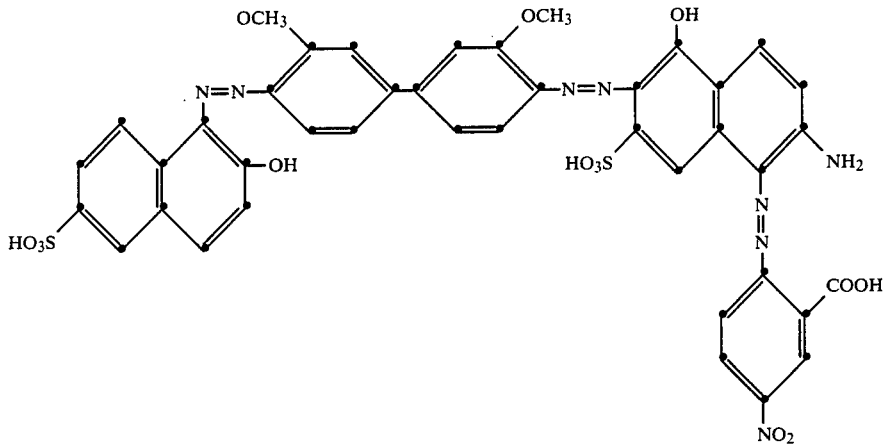 | viscose | 20 minutes at 1 bar in saturated steam |

In Examples 2 to 6, saturated steam means a saturated steam atmospere of 100°-102° C. containing 1.5 to 2% by volume of air.

EXAMPLE 7

A printing paste of the following composition is prepared:

1.5 g of the dye of the formula

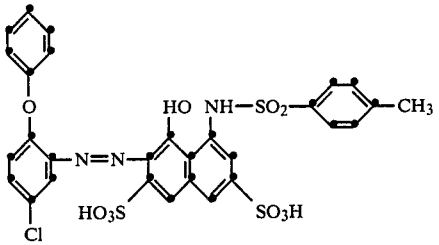

and 100 g of urea are dissolved in 398.5 g of hot water and the solution is stirred into 500 g of a 4% thickener based on hydroxyethylated guar using an impeller.

A knitted synthetic polyamide fabric is printed in conventional manner with this paste and then dried. The print is fixed by steaming the printed fabric for 40 minutes in steam containing 1.5 to 2% by volume of air without overpressure (~1 bar) at 100°-102° C. A level print with a stable shade is obtained.

If a comparison print is fixed in an air-free steam atmosphere, cloudy non-reproducible effects are obtained.

EXAMPLE 8

A printing paste of the following composition is prepared:

1.5 g of the dye of the formula

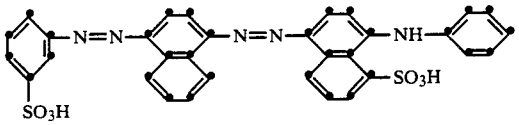

and 100 g of urea are dissolved in 398.5 g of hot water and the solution is stirred into 500 g of a 4% thickener based on hydroxy-ethylated guar using an impeller.

A knitted synthetic polyamide fabric is printed in conventional manner with this paste and then dried. The print is fixed by steaming the printed fabric for 40 minutes in steam containing 1.5 to 2% by volume of air without overpressure (~1 bar) at 100°-102° C. A level print with a stable shade is obtained.

Fixation of a comparison print in an air-free steam atmosphere results in cloudy non-reproducible effects.

Example 9

A fabric consisting of 50% cotton (bleached) and 50% of polyester staple fibres is printed with a printing paste consisting of 1.5 g of a liquid formulation, with low dispersant content, of a mixture of dyes of the formulae

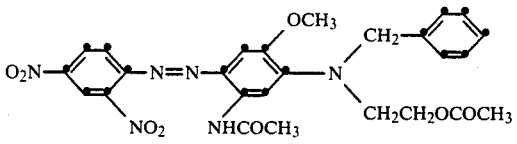

(I)

and

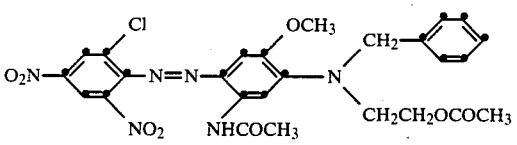

(II)

comprising 25% by weight of the dye of formula I and 75% by weight of the dye of formula II, 2 g of a liquid formulation, with low salt content, of the copper complex of the dye of the formula

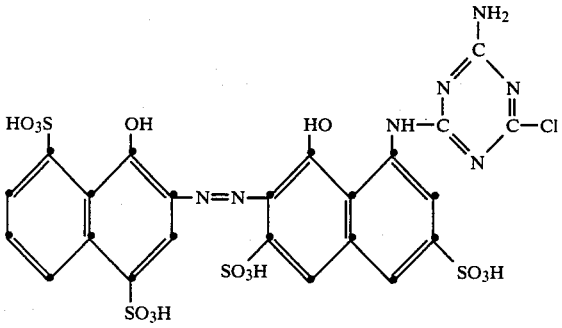

50 g of urea, 416.5 g of water, 20 g of sodium bicarbonate, 10 g of sodium m-nitrobenzenesulfonate, and 500 g of a 10% solution of a low viscosity sodium alginate in water.

After drying, fixation is carried out as follows:

8 min. in saturated steam containing 1.5–2% by volume of air at 102° C., then 8 min. in superheated steam containing 1.5–2% by volume of air at 170° C.

Non-fixed dye is removed by repeated washing with cold and warm water. A level print with a greyish blue stable reproducible shade is obtained.

Repetition of the above described procedure without air results in unlevel bluish pink shades which are not reproducible.

EXAMPLE 10

A bleached cotton calicot fabric which has been treated with alkali and having a weight of 120 g/m$^2$ is impregnated on a pad to a pick-up of 75% with a liquor of the following composition:

2.5 g/l of the dye of the formula

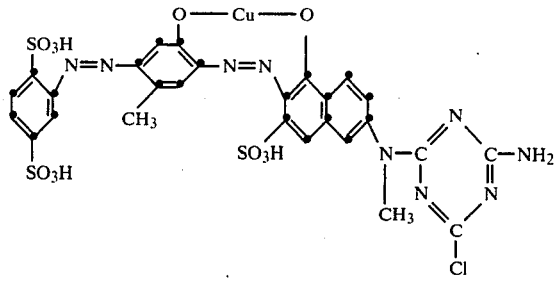

50 g/l of urea, 20 g/l of calcined sodium carbonate, 5 g/l of sodium m-nitrobenzenesulfonate, 50 g/l of a 5% sodium alginate solution.

After drying in a hot flue, the treated fabric is fixed in a continuous steamer for 5 minutes at 101°–103° C. The steamer atmosphere contains 3% of air and the fabric is subsequently rinsed hot and cold and dried.

A reproducible blue shade is obtained. If fixation is carried out in an air-free steamer, the shades are not reproducible.

What is claimed is:

1. A process fixing azo, metal complex azo and formazan dyes on textile fabrics with hot steam to give stable shades, which process comprises drying textile fabrics printed with said dyes and then fixing prints so obtained in hot steam that contains 0.5 to 5% by volume of air.

2. A process according to claim 1, wherein textile fabric printed with dyes that are sensitive to reduction are used.

3. A process according to claim 1, wherein fixation is carried out in steam that contains at least 1% by volume of air.

4. A process according to claim 3, wherein fixation is carried out in steam that contains 1.5 to 5% by volume of air.

5. A process according to claim 4, wherein fixation is carried out in steam that contains 1.5 to 3.5% by volume of air.

6. A process according to claim 1, wherein textile fabrics printed with water-insoluble and/or water-soluble dyes are used.

7. A process according to claim 6, wherein textile fabrics printed with water-soluble reactive dyes are used.

8. A process according to claim 1, wherein textile blended fabrics printed with mixtures of dyes containing at least one water-soluble reactive dye and at least one disperse dye are used.

9. A process according to claim 1, wherein printed cellulose fabric is used.

10. A process according to claim 8, wherein printed polyester/cellulose blends are used.

11. A process according to claim 10, which comprises using a polyster/cellulose blend that is printed with a printing paste containing at least one water-soluble reactive dye, at least one disperse dye, alginate and fixation alkali.

12. A process according to claim 1, wherein fixation is carried out under normal pressure.

13. A process according to claim 1, wherein fixation is carried out in the temperature range from 100° to 220° C.

14. A process according to claim 1, which comprises using textile fabrics that are printed with printing pastes containing a reduction promoting thickener.

15. A process according to claim 1, which comprises fixing polyester/cellulose blends which are printed with a printing paste that contains at least one fibre-reactive sulfo group containing azo or metal complex azo dye, at least one azo disperse dye, alginate and a fixation alkali, in steam that contains 1.5 to 3.5% by volume of air, under normal pressure and in the temperature range from 150° to 220° C.

* * * * *